US010488017B2

(12) United States Patent
Lee

(10) Patent No.: US 10,488,017 B2
(45) Date of Patent: Nov. 26, 2019

(54) LED LIGHTING DEVICE FOR COLORED LIGHTING

(71) Applicant: Bitro Group, Inc., Hackensack, NJ (US)

(72) Inventor: Ki S. Lee, Palisades Park, NJ (US)

(73) Assignee: Bitro Group, Inc., Hackensack, NJ (US)

( * ) Notice: Subject to any disclaimer, the term of this patent is extended or adjusted under 35 U.S.C. 154(b) by 230 days.

(21) Appl. No.: 14/711,373

(22) Filed: May 13, 2015

(65) Prior Publication Data

US 2015/0338062 A1 Nov. 26, 2015

Related U.S. Application Data

(60) Provisional application No. 62/001,826, filed on May 22, 2014.

(51) Int. Cl.

| | |
|---|---|
| ***F21V 9/08*** | (2018.01) |
| ***F21K 9/60*** | (2016.01) |
| *F21V 3/04* | (2018.01) |
| *F21Y 113/00* | (2016.01) |
| *F21Y 115/10* | (2016.01) |

(52) U.S. Cl.

CPC ..... *F21V 9/08* (2013.01); *F21K 9/60* (2016.08); *F21V 3/04* (2013.01); *F21Y 2113/00* (2013.01); *F21Y 2115/10* (2016.08)

(58) Field of Classification Search

CPC ..... F21K 9/60; F21K 9/00; F21K 9/08; F21V 3/04; F21Y 2113/00; F21Y 2115/10

See application file for complete search history.

(56) References Cited

U.S. PATENT DOCUMENTS

| | | | | |
|---|---|---|---|---|
| 8,403,518 | B2 * | 3/2013 | Sohn | F21L 4/08 362/157 |
| 2008/0278063 | A1 * | 11/2008 | Cok | B82Y 20/00 313/500 |
| 2009/0128781 | A1 * | 5/2009 | Li | G02B 6/0008 353/20 |
| 2011/0157896 | A1 * | 6/2011 | Yu | F21V 9/08 362/293 |
| 2015/0021584 | A1 * | 1/2015 | Guard | G06F 3/0412 257/40 |
| 2015/0055321 | A1 * | 2/2015 | Harbers | F21V 7/0008 362/84 |

* cited by examiner

*Primary Examiner* — Thien M Le
*Assistant Examiner* — April A Taylor
(74) *Attorney, Agent, or Firm* — Myers Wolin, LLC

(57) ABSTRACT

A light emitting diode (LED) device is provided including an LED, a transparent cover configured for retaining a color filter, and a first color filter configured to be retained by the transparent cover. The color filter, when retained by the transparent cover, is functionally disposed in front of the LED such that light leaving the lighting assembly passes through the color filter.

17 Claims, 3 Drawing Sheets

LED LIGHTING DEVICE FOR COLORED LIGHTING

CROSS-REFERENCE TO RELATED APPLICATIONS

This application claims priority to U.S. Provisional Application No. 62/001,826, filed May 22, 2014, the contents of which are incorporated by reference herein in their entirety.

FIELD OF THE INVENTION

This disclosure relates to an LED lighting assembly for providing precisely colored light output.

BACKGROUND

Often it is desirable to modify a mass produced LED light source or LED lighting device, such as an LED module array to be used in a custom application requiring colored lighting. LED module arrays are modular LED systems that are used as light sources for many applications, such as backlighting signs, lighting coves, reveals, stairways, showcases, shelving systems, decorations, and others. Flexibility and scalability of modular array systems make them easy to implement in a variety of lighting environments, if the color of the light output of the system can be properly adapted.

Typically, such modules are offered in several shades of white that follow black body curves (signified by Kelvin temperature values) and occasionally in limited colors, such as red, green, blue, amber, and yellow. When a specific color is desired that is not among the limited color offerings typically manufactured, custom production processes are used, which require large minimum orders well beyond the needs of most custom projects (in the tens of thousands of units). It is therefore prohibitively expensive to produce custom colors for all but the largest of custom projects. Further, it is generally impossible to receive samples of colors to be produced, since LED packages cannot necessarily be produced in small quantities that would match the results of mass production, and even when they can, there is no guarantee that the color will appear identical when mass produced.

An alternative option is to use RGB LED lighting sources, capable of being programmed to output a variety of colors. These systems combine programmed intensities of red, green, and blue, to enable the production of a wide variety of colors. However, these units are expensive to produce, require control systems (an additional expense) and often burn out faster than dedicated colors (particularly for brighter colors that run hotter). Therefore, producing different shades of colors in LEDs is typically difficult and expensive to install, set up, maintain, and service. Further, the color of programmable installations tends to change over time, causing problems when a specific custom color is required in a long term installation.

Further, several types of applications require very precise colors. As discussed above, if the precise colors required are atypical, they may not be available—particularly for smaller projects. If the precise colors are available, manufacturing with the required tolerances may require special tooling and production runs, and may therefore be prohibitively expensive.

For example, custom color projects often require LED signage that appears in the same color (and shade) when viewed during the daytime or at night. These projects often involve a corporate color that may be proprietary or trademarked (such as a college or sport team color). Therefore, precision in the color is required, and the color is unlikely to be available off the shelf. For daytime viewing, a color filter is typically applied to a front surface of signage, which can provide an accurate color. However, in these installations, when a traditional LED lighting device is placed within the signage, the color generally appears washed out. This is particularly problematic in the case of lighter colors, such as pink, teal, orange, magenta, yellow, and others.

Further, some custom signage is designed to provide a color during the daytime but to illuminate in white at night. One example of such application uses a DuLite proprietary acrylic panel. The panel is colored to the desired color for daytime viewing, and only appears as white at night when an LED light having a specified precise color temperature is used.

Production of the specialized white shade with the tolerances required for this type of custom application often requires a large order with a high cost per LED. Further, because the white temperature required may not be useful in other applications, it is very expensive to keep stock of the required LED light sources, since such expensive and precisely manufactured LEDs may have no other commercial demand.

Because of the high cost and bulk requirements of the required precisely manufactured LEDs, RGB LEDs may be used to produce the required color temperature. However, RGB LEDs are imprecise when used for white colors, and tend to shift over time—particularly for shades of white.

Previously developed systems for changing the output color of an LED array are flawed for these applications. For example, theater lighting applications, such as those used for incandescent and fluorescent applications, typically used color filters designed to be swapped in front of a housing. However, such assemblies do not work well when used with LED stage lighting, and do not transition well to LED lighting arrays or linear bars for permanent installations using existing filters. The filters filter too much light, making the LED devices on which they were applied too dim for use. Further, the existing systems could not be matched to custom applications as required, nor are they configured for integration into durable housings for LEDs for long term outdoor use.

Some manufacturers develop LED solutions with pigmented plastic covers or housings. However, the pigmented cover must them be mass produced, and cannot be modified—leading to similar stocking and manufacturing issues to those described above.

There is a need, therefore, for a LED lighting device that can be inexpensively produced and installed in custom colors tailored to the installation.

SUMMARY

A light emitting diode (LED) device is provided comprising an LED, a transparent cover configured for retaining a color filter, and a color filter configured to be retained by the transparent cover. The color filter, when retained by the transparent cover, is functionally disposed in front of the LED such that light leaving the lighting assembly passes through the color filter.

The LED device may further comprise a housing for retaining both the LED and the transparent cover is fixed to the housing, with the housing and the transparent cover combining to fully enclose the LED. The cover may be permanently fixed or removably fixed to the housing.

The color filter may be applied to an outside surface of the transparent cover opposite the LED or an inside cover facing the LED. In some embodiments, the cover contains a pocket for retaining the first color filter.

The color filter is selected to modify the light emitted by the LED to a color, and may be used in conjunction with a secondary color filter, such as one external to the device. The color may be a shade of white, for example, defined by a specified color temperature.

In some embodiments, the device, or a larger assembly, may contain two color filters. The second color filter may be incorporated into a front surface of the transparent cover.

The front surface of the color filter may provide a first color when the LED lighting assembly provides light and provides a second color when the LED does not provide light. In some embodiments, the cover may provide the same color in each case, and the color filter or filters may be selected so that the colors can match. Alternatively, the color filter or filters may be selected so that the first color and the second color are different colors.

DETAILED DESCRIPTION OF THE PREFERRED EMBODIMENTS

Figure 1:
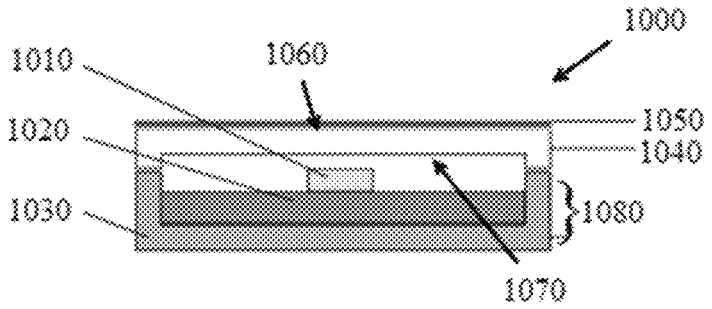
FIGS. 1 and 2 show a first exemplary embodiment of an LED lighting device.

The description of illustrative embodiments according to principles of certain embodiments is intended to be read in connection with the accompanying drawings, which are to be considered part of the entire written description. In the description of certain embodiments disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of certain embodiments are illustrated by reference to the exemplified embodiments. Accordingly, every embodiment expressly should not be limited to such exemplary embodiments illustrating some possible non-limiting combination of features that may exist alone or in other combinations of features.

This disclosure describes the best mode or modes of practicing certain embodiments as presently contemplated. This description is not intended to be understood in a limiting sense, but provides examples solely for illustrative purposes by reference to the accompanying drawings to advise one of ordinary skill in the art of the advantages and construction of certain embodiments. In the various views of the drawings, like reference characters designate like or similar parts.

Figure 2:
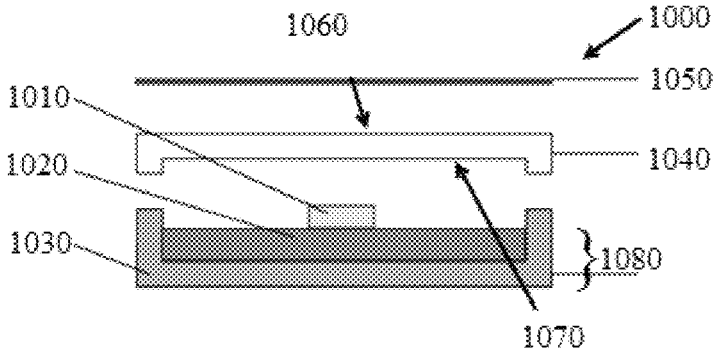

FIGS. 1 and 2 show a first exemplary embodiment of a light emitting diode (LED) lighting device 1000. The LED lighting device 1000 may be used to provide a point of light, or may be coupled with other LED lighting devices to provide even lighting in a specified color across some amount of space. The LED lighting device 1000 may be placed, for example, within an LED light box or within channel letters to backlight a surface or image. Alternatively, the LED lighting device 1000 may be applied in any other situation where a substantially precise color is required.

The LED lighting device 1000 comprises an LED light source 1010 disposed on a printed circuit board (PCB) 1020 within a housing 1030, which components combine to form a base module 1080. The housing 1030 may contain any wire leads necessary for powering the LED lighting device 1000. The LED light source 1010 is enclosed within the housing using a transparent cover 1040 configured for retaining a color filter 1050. The color filter 1050 is retained by the transparent cover 1040 such that any light leaving the housing 1030 from the LED light source 1010 passes through the color filter.

In FIGS. 1 and 2, the color filter 1050 is shown as retained on the outer surface 1060 of the transparent cover 1040 such that the transparent cover is between the LED light source 1010 and the color filter. The color filter may, alternatively, be placed on the inner surface 1070 of the transparent cover 1040 or in a pocket or slot disposed within the transparent cover, so long as a substantial portion to all of the light emitted from the LED light source 1010 passes through the color filter. The transparent cover 1040 may be configured such that readily available vinyl or plastic sheets may be applied as the color filter 1050.

The housing 1030 may be metal or plastic, or any other material, so long as the material is sufficiently opaque such that substantial light emitted from the LED light source 1010 does not pass through the housing and affect the color of the light passing through the color filter 1050.

The base module 1080 comprising the LED light source 1010, the PCB 1020, and the housing 1030, may be a mass produced LED modular array containing many LED light sources mounted on one or more PCB within a larger housing, or a mass produced single LED module. The base module 1080 may be configured as an elongated LED bar to generate a line of lighting, for example. The base module 1080 may be configured with a quick connect feature for providing consistent mounting and power to the LED lighting device 1000, and it may contain additional elements for consistently spacing the LED light sources or the modules containing the LED light sources themselves. The connection features of the modules may be configured for providing flexible mounting of the LED lighting device 1000, and the device may therefore provide for combining multiple devices to form a bar of a desired length, in specified curves, or other shapes, for fitting within custom signage (such as channel letters).

Typically, the LED lighting device would operate with constant voltage inputs, either low voltage (typically 12V or 24V), or high voltage in AC (90 VAC-277 VAC). However, other configurations are possible.

The transparent cover 1040 is typically configured to fit the base unit 1080, and is placed in the direction of light emission from the base unit. The transparent cover 1040 may be of different plastics, including polycarbonate, acrylic, ABS, PVC, or other transparent materials, such as glass (including tempered glass for operation in high temperature environments), or some combination of materials. The formulation of the transparent cover 1040 may contain additives, such as UV inhibition additives for resisting yellowing.

The transparent cover 1040 for the LED lighting device 1000 is configured with a flat surface, or flat surfaces 1060, 1070 for retaining a color filter 1050. The color filter 1050 may be a substrate having an adhesive surface for application to a flat surface of the transparent cover 1040, or it may be an opaque sheet placed within a slot on the transparent cover. The color filter 1050 may then be placed in front of the LED light source 1010 for modifying the illumination color or wavelength characteristics in the light source, or LED modular arrays.

The transparent cover 1040 is mounted onto the base module 1080 in close proximity to the LED light source 1010 so that it filters all, or substantially all, light emitted from the LED light source. It may be permanently applied to the base module 1080, or it may be removable so that it may be replaced with a transparent cover with a different color filter 1050 applied. This allows for the changing of the color of the LED lighting device 1000 for different custom applications, or seasonally, for example.

The color filter 1050 is a translucent sheet that is applied on top of or in front of the LED to filter and transform a white (or other colored) light source to a light source specific to an application. The color filter may be a plastic film or card, or a vinyl with colored pigmentation for filtering unwanted wavelengths from the spectrum of light emitted. The color filter 1050 preferably has a high transmission rating or it may, alternatively, be translucent (diffused) with color pigmentation and have a diminished light transmission.

The color filter 1050 is typically selected for a long operating life (at least 3 years under UV rays) and is applied as a final step during construction of the LED lighting device 1000 or as a secondary process after the manufacturing of the LED lighting device. In this way, the LED lighting device 1000 may be mass produced, and the color filter may be created and applied at a relatively low cost during a custom installation for a specified application of the device.

Figure 3:
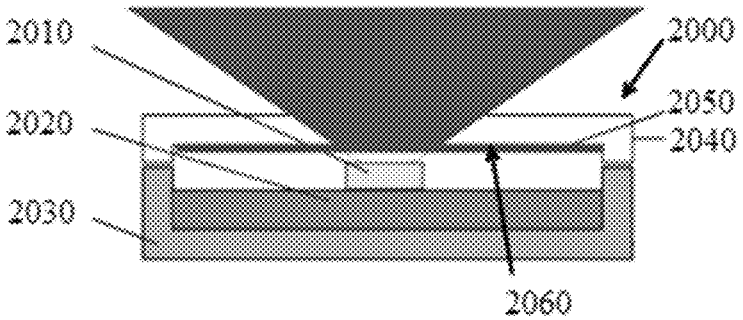
FIG. 3 shows a second exemplary embodiment of an LED lighting device.

FIG. 3 shows an LED lighting device 2000 with an LED light source 2010 disposed on a PCB 2020 within a housing 2030 with a transparent cover 2040 configured for retaining a color filter 2050 on the inner surface 2060 of the transparent cover. The color filter 2050 in the embodiment shown is of a dark color, such as purple, so that the lighted emitted from the LED light source 2010 is of a color related to the color of the color filter.

Figure 4:
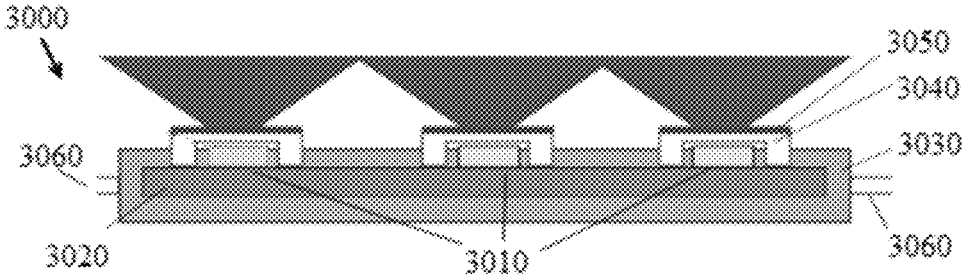
FIG. 4 shows an LED lighting device with multiple LED light sources on a single PCB.

FIG. 4 shows an LED lighting device 3000 with multiple LED light sources 3010 disposed on a single PCB 3020 within a housing 3030. Each LED light source 3010 has a transparent cover 3040, each of which is provided with a color filter 3050. The housing 3030 is provided with lead wires 3060 for providing power to the PCB 3030. It will be understood that in alternative embodiments, a single transparent cover with a single color filter may be applied.

The assembly in any of the above embodiments may be provided to a user with the base unit 1080 fully assembled, and with the transparent covers 1040, 2040, 3040 either permanently applied or detachable, so long as the application of the color filter 1050, 2050, 3050 may be performed by an installer or user or at the end of the manufacturing process.

Figure 5:
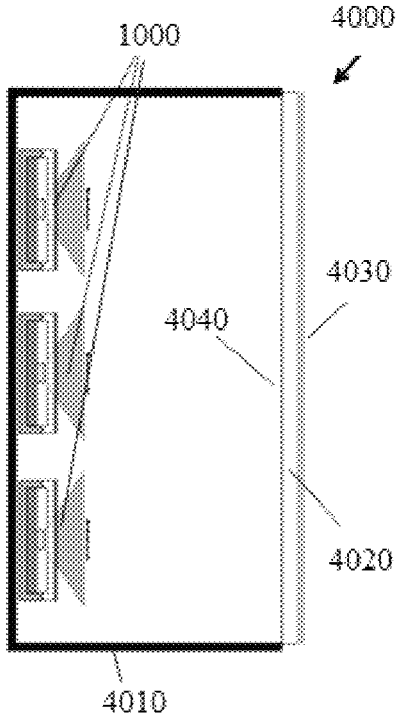
FIG. 5 shows an LED lighting assembly incorporating the LED lighting devices of FIGS. 1-2.

FIG. 5 shows an LED lighting assembly 4000 incorporating three of the LED lighting devices 1000 discussed above. In a typical application a traditional signage lighting application may contain a large housing 4010 containing a front surface 4020 used as a viewable surface. The LED lighting assembly 4000 may be an industrial sign, for example, designed to be viewable during the day and night. Often, the front surface must be a specific corporate color during both day and night viewings.

A secondary color filter 4030 may be applied to the front surface 4020 to provide the viewable surface with a desired color—such as a specified corporate color. Traditionally the secondary color filter 4030 for such LED lighting assemblies is selected to provide the desired color for daytime viewing. LED lighting modules placed within the housing 4010 then apply white light (or light in the natural color of the LED used) to the back side 4040 of the front surface, and the color provided at night with the LED lighting assembly 4000 illuminated appears washed out. In some embodiments, the secondary color filter 4030 is integrated into the front surface 4020, such that the front surface is impregnated with a color pigment acting as a secondary color filter 4030.

When the LED lighting assembly 4000 is used in conjunction with the LED lighting device 1000 above, the light applied to the back side 4040 of the front surface 4020 is then tinted to a color associated with the desired color. In this way, the application of colored light to the back side 4040 of the front surface 4020 enhances the saturation of the color on the face of the front surface 4020 selected for the secondary filter 4030, thereby avoiding the washout of color typically experienced in these applications.

The amount of washout associated with such an LED lighting assembly 4000 varies with the natural color of the LED light source 1010 used inside the large housing 4010. Further, manufacturing an LED light source 1010 to provide a specified color and color temperature may be prohibitively expensive. The base module 1080 of the LED lighting device 1000 may then be mass produced for a variety of applications, and the transparent cover may be applied with color filters 1050 empirically selected for the specified application. In other words, a transparent cover 1040 may be manufactured with the LED lighting device, and placed within the LED lighting assembly 4000. The degree of washout may then be evaluated, and a variety of color filters 1050, which may be manufactured and applied inexpensively, may then be tested to determine which color filter 1050 when applied to the specific LED lighting device 1000 within the specific LED lighting assembly 4000 provides the best nighttime color.

Similarly, color LEDs are typically mass produced in only a few colors. However, a company may have a trademarked color used in corporate signage that they would like to present during both day and night. The appropriate LED coloration may not be available precisely because the color is proprietary to the specified business (therefore less demand for that color across the industry) or it may be a unique color selected to differentiate a company from others within the industry. In such a case, this same empirical process may be applied. The closest LED color available in mass production may be selected for use in the LED lighting assembly, and color filters 1050 may be empirically selected for matching daytime and nighttime colors used in the signage. This is particularly critical for light colors used in signage, such as pinks, where washout is likely without accounting for the backlighting color. In traditional LED lighting assemblies with typical LED lighting devices, colors are presented as washed out or fabricators go through substantial research and development iterations to produce colors that are satisfactory to the customer. In the manner described, a single batch of LED lighting devices 1000 may be produced and then modified during installation to provide the desired color.

Figure 6:
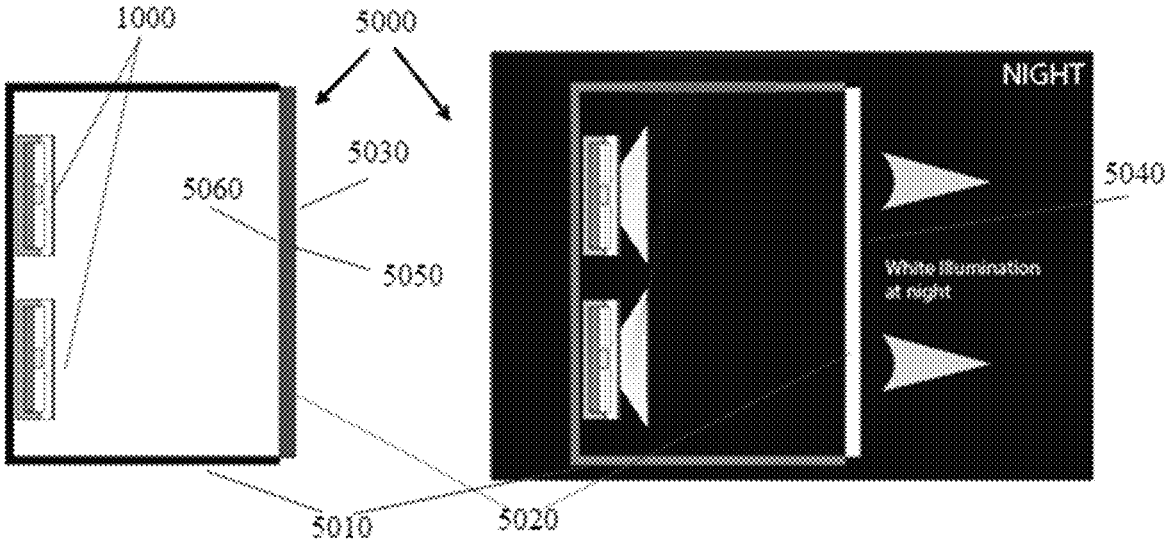
FIG. 6 shows an alternative exemplary embodiment of an LED lighting assembly incorporating two of the LED lighting devices of FIGS. 1-2.

FIG. 6 shows an exemplary alternative embodiment of an LED lighting assembly 5000 incorporating two of the LED lighting devices 1000 discussed above. The LED lighting assembly 5000 contains a large housing 5010 containing a front surface 5020 used as a viewable surface. The LED lighting assembly 5000 may be an industrial sign, for example, designed to be viewable during the day and night. In the embodiment shown, a special panel is used for the front surface 5020 which is designed to show a color 5030 during the day, and to show white 5040 at night.

The front surface 5020 has a secondary color filter 5050 incorporated into the panel that allows certain wavelengths of light to pass through unfiltered, allowing the signage to show white 5040 when appropriate LED lighting devices are used. When this specialized application is used, the secondary color filter 5050 for such LED lighting assemblies is selected to provide the desired color for daytime viewing. LED lighting modules placed within the large housing 5010 then apply white light (or light in the natural color of the LED used) to the back side 5060 of the front surface, and the color provided at night with the LED lighting assembly 5000 illuminated appears as white. However, these assemblies only appear as white when the LED lighting devices used provide a precise shade of white, and the precision required leads to a very expensive manufacturing and installation.

When the LED lighting assembly 5000 is used in conjunction with the LED lighting devices 1000 above, the light applied to the back side 5060 of the front surface 5020 is then tinted to a color temperature required by the application.

The base module 1080 of the LED lighting device 1000 may then be mass produced for a variety of applications, and the transparent cover may be applied with color filters 1050 empirically selected for the specified application. In other words, a transparent cover 1040 may be manufactured with the LED lighting device, and placed within the LED lighting assembly 5000. Different color filters 1050 may then be applied to the LED lighting device 1000 until the appropriate color temperature is achieved (by applying either yellow or orange-red filters, for example). This technique applied with the described LED lighting device may then allow a basic LED light source manufactured with relatively low tolerances to be used for multiple applications, even where tremendous color temperature precision is typically required, bringing down the cost of custom installations dramatically.

Figure 7:
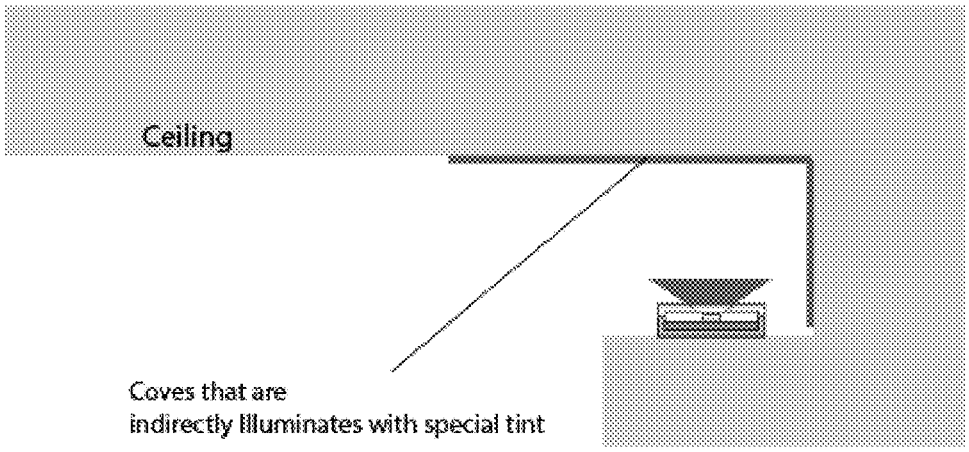
FIG. 7 shows an alternative exemplary application of the LED lighting device of FIGS. 1-2.

FIG. 7 shows an alternative application of the LED lighting devices 1000 described above. Typically, installations in coves, and other indirect lighting applications, such as reveals, require a precise shade to achieve a desired result. However, it is often difficult to predict what a specific shade will look like once installed (since a degree of washout and coloration may be affected by many factors, including the size of the applied, the distance between the light source and the surface being illuminated, etc.). Therefore, an LED lighting device 1000 as described above may be installed, and then a color filter 1050 may be selected specifically for the space being lit. Similarly, a removable transparent cover 1040 may be used, such that the lighting may be modified (to track seasonal colors or other trends, for example). Currently, lighting systems may be adjustable using an LED providing multiple colors. However, such installations are expensive and often burn out faster than single color LEDs. The LED lighting device 1000 described may therefore provide a less expensive and more durable solution.

Additional applications for the LED lighting device 1000 as well. For example, often hotels or restaurants require lighting to match a specific ambiance. This may require a very low color temperature, on the order of 1900 Kelvin. However, LEDs are difficult and expensive to manufacture at such low color temperatures, making it difficult to replace easily dimmed incandescent lights with cheaper and more durable LED lighting. Using a yellow or orange-red color filter 1050, the color temperature of a traditional low Kelvin LED color, such as 3000 K or 2700 K can easily bring the color temperature down to a lower desired temperature.

While certain embodiments have been described at some length and with some particularity, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope.

What is claimed is:

1. A light emitting diode (LED) lighting device comprising:

an LED light source;

a transparent cover configured for retaining a first color filter; and the first color filter configured to be retained by the transparent cover; and a second color filter opposite the transparent cover from the first color filter, wherein the first color filter, when retained by the transparent cover, is functionally disposed in front of the LED light source, and between the LED light source and the second color filter, such that light leaving the lighting assembly passes through the first color filter and the second color filter, and wherein the first color filter is selected to modify the light emitted by the LED light source to a color in conjunction with the second color filter when the LED light source is active, and wherein the second color filter determines a first color for a front surface of the lighting device when the LED light source is inactive, and wherein the first color filter in conjunction with the second color filter determines a second color for the front surface of the lighting device when the LED light source is active.

2. The device of claim 1 further comprising a housing, and wherein the LED light source is fixed in the housing and the transparent cover is fixed to the housing.

3. The device of claim 2, wherein the transparent cover and the housing combine to fully enclose the LED light source.

4. The device of claim 2 wherein the transparent cover is removably fixed to the housing.

5. The device of claim 1 wherein the first color filter is applied to a surface of the transparent cover facing the LED light source and the second color filter is applied to an opposite surface of the transparent cover.

6. The device of claim 1 wherein the transparent cover contains a pocket for retaining the first color filter.

7. The device of claim 1 wherein the second color filter is external to a housing of the device.

8. The device of claim 1 wherein the first color filter is selected to modify the color temperature of the LED light source to a specified color temperature.

9. A light emitting diode (LED) lighting assembly comprising:

an LED light source;

a transparent cover configured for retaining a first color filter;

the first color filter configured to be retained by the transparent cover;

a housing having a front surface; and a second color filter opposite the transparent cover from the first color filter, wherein the first color filter, when retained by the transparent cover, is functionally disposed in front of the LED light source such that any light leaving the lighting assembly passes through the first color filter, the front surface, and the second color filter, wherein the first color filter affects a first color for light emitted from the LED lighting assembly when the LED lighting assembly provides light and the front surface and the second color filter provides a second color when the LED lighting assembly does not provide light.

10. The lighting assembly of claim 9 wherein the second color filter is incorporated into the front surface.

11. The lighting assembly of claim 10 wherein the second color filter is selected to provide a specific color when no light is emitted from the lighting assembly, and the first color filter is selected to combine with the second color filter to provide a specific color when light is emitted from the lighting assembly.

12. The lighting assembly of claim 9 wherein the first color and the second color are the same color.

13. The lighting assembly of claim 12 wherein the first color and the second color are the same color as the second color filter and the first color filter is selected such that any light emitted from the lighting assembly appears to be the same color as the first color.

14. The lighting assembly of claim 9 wherein the first color and the second color are different colors.

15. The lighting assembly of claim 14 wherein the first color is white.

16. The lighting assembly of claim 15 wherein the first color filter is selected such that light passing through the first color filter is of a specific color temperature.

17. A method of assembling a lighting assembly, the lighting assembly comprising:

an LED light source;

a transparent cover configured for retaining a first color filter;

the first color filter;

a housing having a front surface; and a second color filter opposite the transparent cover from the first color filter, and the method comprising:

selecting a color for the second color filter such that the second color filter is a first color of the lighting assembly when the lighting assembly does not emit light;

applying the second color filter at the front surface of the housing;

selecting a color for the first color filter such that when light from the LED light source passes through the first color filter and the second color filter, the front surface of the housing is a second color;

applying the first color filter to the transparent cover;

placing the transparent cover between the LED light source and the front surface such that any light emitted from the LED light source passes through the first color filter; and placing the transparent cover and LED light source within the housing.

* * * * *